US012296934B2

(12) United States Patent
Sorkin et al.

(10) Patent No.: US 12,296,934 B2
(45) **Date of Patent: *May 13, 2025**

(54) DUAL STRUT POWER TRANSMISSION HOUSING STRUCTURE OF A MARINE PROPULSION SYSTEM

(71) Applicant: Flux Marine Ltd., Narragansett, RI (US)

(72) Inventors: Benjamin Sorkin, Melville, NY (US); Jonathan Lord, Providence, RI (US)

(73) Assignee: Flux Marine Ltd., East Greenwich, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/384,119

(22) Filed: Oct. 26, 2023

(65) Prior Publication Data

US 2024/0051652 A1 Feb. 15, 2024

Related U.S. Application Data

(63) Continuation of application No. 17/334,095, filed on May 28, 2021, now Pat. No. 11,834,144.
(Continued)

(51) Int. Cl.
*B63H 20/34* (2006.01)
*B63H 20/14* (2006.01)
(Continued)

(52) U.S. Cl.
CPC ..... *B63H 20/34* (2013.01); *B63H 20/14* (2013.01); *B63H 20/28* (2013.01); *B63H 2020/323* (2013.01)

(58) Field of Classification Search
CPC ..... B63H 20/34; B63H 20/14; B63H 20/28; B63H 2020/323
See application file for complete search history.

(56) References Cited

U.S. PATENT DOCUMENTS 2,345,689 A 4/1944 Snadecki
2,979,019 A 4/1961 Donald et al.
(Continued)

FOREIGN PATENT DOCUMENTS

FR 969679 A 12/1950
GB 2429763 A 3/2007
(Continued)

OTHER PUBLICATIONS

International Search Report and Written Opinion for International Application No. PCT/US21/34904 mailed Aug. 25, 2021.
(Continued)

*Primary Examiner* — Stephen P Avila
(74) *Attorney, Agent, or Firm* — Stephen J. Kenny; Foley Hoag LLP

(57) ABSTRACT

A marine propulsion apparatus including a first strut and a second strut, each extending from a proximal end to a distal end, wherein the proximal ends of the first and second struts are coupled to an anti-ventilation plate, a lower unit coupled to the distal ends of the first strut and the second strut, the lower unit the lower unit housing a sprocket, a shaft rotatably coupled to the sprocket, a propeller coupled to the shaft proximate the tail portion of the lower unit, the propeller configured to rotate with the shaft, a belt rotatably coupling the drive shaft to the sprocket, wherein the belt is disposed within the interior belt voids of the first and second struts; and at least one thermal circuit channel extending through a portion of the anti-ventilation plate, the at least one thermal circuit configured to channel a coolant to flow therethrough.

20 Claims, 12 Drawing Sheets

Related U.S. Application Data

(60) Provisional application No. 63/031,979, filed on May 29, 2020.

(51) Int. Cl.
*B63H 20/28* (2006.01)
*B63H 20/32* (2006.01)

(56) References Cited

U.S. PATENT DOCUMENTS

| | | | |
|---|---|---|---|
| 3,951,096 | A | 4/1976 | Dunlap |
| 5,178,566 | A | 1/1993 | Stojkov et al. |
| 5,435,763 | A | 7/1995 | Pignata |
| 10,065,723 | B2 | 9/2018 | Baumberger |
| 2012/0241139 | A1 | 9/2012 | Katoh et al. |
| 2016/0153545 | A1 | 6/2016 | Kücükyavuz et al. |
| 2020/0254888 | A1 | 8/2020 | Weiss et al. |
| 2021/0371072 | A1 | 12/2021 | Sorkin |
| 2024/0051652 | A1* | 2/2024 | Sorkin ..... B63H 20/28 |

FOREIGN PATENT DOCUMENTS

| | | | |
|---|---|---|---|
| WO | WO-2021/243239 | A1 | 12/2021 |
| WO | WO-2023/137055 | A2 | 7/2023 |
| WO | WO-2023/137055 | A3 | 8/2023 |

OTHER PUBLICATIONS

Invitation to Pay Additional Fees for Application No. PCT/US23/10586 dated Mar. 23, 2023.
International Search Report and Written Opinion for International Application No. PCT/US2023/10586 dated Jul. 6, 2023.
Supplementary European Search Report for EP Application No. 21813726.3 dated Jun. 6, 2024.

* cited by examiner

DUAL STRUT POWER TRANSMISSION HOUSING STRUCTURE OF A MARINE PROPULSION SYSTEM

CROSS-REFERENCE TO RELATED APPLICATION

This application is a Continuation of U.S. Non-Provisional patent application Ser. No. 17/334,095, filed on May 28, 2021, now U.S. Pat. No. 11,834,144, issued on Dec. 5, 2023, which claims the benefit of U.S. Provisional Patent Application No. 63/031,979, filed on May 29, 2020. The entire contents of each of these applications are hereby incorporated by reference.

FIELD OF THE DISCLOSURE

This disclosure is directed toward a marine propulsion system, more particularly, the housing structure for power transmission between a prime mover and a propeller shaft.

BACKGROUND

Marine Propulsion engines have historically been categorized into three general types: inboard marine propulsion systems, outboard marine propulsion systems, and sterndrive, or, inboard/outdrive marine propulsion systems.

Inboard propulsion systems comprise a prime mover that uses an energy source to convert energy into rotational motion of a shaft or shafts, a transmission that conveys that rotational power to a propeller shaft which protrudes from the bottom of a boat hull. A propeller is fastened to the end of that submerged shaft and generates thrust, which is directed by a rudder, usually located aft of the propeller. An outboard engine generally comprises a powerhead with a prime mover, a lower unit, or gearcase that houses a propeller and shaft, and a midsection that provides physical connection between the powerhead and lower unit while allowing a power transmission device to transfer power from the prime mover to propeller shaft. The entirety of the outboard engine mounts to the transom of a boat and can be removed. Sterndrive systems, also called inboard/outboard, or drive systems, house the prime mover inside of the boat. The shaft of the prime mover is connected to an outdrive transmission that transmits power to a lower unit or gearcase.

Sterndrive and outboard marine propulsion systems traditionally use a set of right-angle bevel gears to transmit rotational power from a prime mover to the propeller. An additional gear set is used in the case of combustion engines to enable reversing rotation.

A variety of power transmission methods is known from prior art, including belt or chain transmission arrangements. Synchronous belts have become strong and durable, enabling potential use in higher power marine engine transmissions. Implementation of such belt technologies present challenges in physical housing arrangements and mechanical assembly. Frontal area and hydrodynamic shape of submerged portions of marine propulsion systems greatly affects system drag and efficiency. Accommodating belt drive technologies with traditional physical architecture that was designed to house rotating shafts and gears creates hurdles in overall efficient design. Embodiments of the present disclosure are intended to address the above challenges as well as others.

BRIEF SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a marine propulsion apparatus comprising: a first strut extending from a proximal end to a distal end and a second strut extending from a proximal end to a distal end, each of the first strut and the second strut having a leading portion, an interior belt void, and a trailing portion, wherein the first strut is aligned with the second strut and the first strut is spaced from the second strut; a lower unit coupled to the distal ends of the first strut and the second strut, the lower unit comprising a nose portion, a middle portion, and a tail portion; a sprocket rotatably disposed within the lower unit; a shaft rotatably coupled to and concentric with the sprocket, the shaft having a front side extending to the front of the sprocket and a rear side extending to the rear of the sprocket; a belt rotatably coupling the drive shaft to the sprocket, wherein a first portion of the belt is disposed within the interior belt void of the first strut and a second portion of the belt is disposed within the interior belt void of the second strut; and a thermal circuit extending from the cowling, through each of the first strut and the second strut, and into the lower unit, wherein the thermal circuit comprises a heat transfer fluid configured to flow therethrough.

In some embodiments, the first and second struts have a complimentary shape.

In some embodiments, the space between first and second struts is uniform over the length of the struts.

In some embodiments, the thermal circuit is disposed within the leading portion of each of the first strut and the second strut.

In some embodiments, the thermal circuit is bidirectional through each of the first strut and the second strut.

In some embodiments, the thermal circuit further extends through the middle portion of the lower unit.

In some embodiments, the thermal circuit further extends through the tail portion of the lower unit.

In some embodiments, a plate disposed at the proximal ends of the first strut and the second strut, the plate being substantially perpendicular to the first strut and the second strut.

In some embodiments, a propeller coupled to the rear side of the shaft.

In some embodiments, the lower unit comprises a nose cone and a tail fairing.

In some embodiments, the sprocket is disposed within the middle portion of the lower unit In some embodiments, the first strut and the second strut are substantially linear.

In some embodiments, the first strut and the second strut each comprise an airfoil shape, wherein a leading edge of the airfoil shape corresponds to the leading portions of the first strut and the second strut and a trailing edge of the airfoil shape corresponds to the trailing portions of the first strut and the second strut.

In some embodiments, at least one strut includes a removable trailing edge portion.

In some embodiments, one or more skegs can extend from the lower unit.

In some embodiments, at least one strut and the lower unit are formed as separate components.

In some embodiments, the thermal circuit forms a closed circuit fluid path.

In some embodiments, a distal end of at least one strut is disposed at middle portion of the lower unit.

In some embodiments, the interior belt void and the coolant circuit are discrete channels.

In accordance with another aspect of the disclosure, a marine propulsion apparatus is provided which comprises: a first strut extending from a proximal end to a distal end and a second strut extending from a proximal end to a distal end, each of the first strut and the second strut having a leading portion, an interior belt void, and a trailing portion, wherein the first strut is aligned with the second strut and the first strut is spaced from the second strut; a lower unit coupled to the distal ends of the first strut and the second strut, the lower unit comprising a nose portion, a middle portion, and a tail portion; a sprocket rotatably disposed within the lower unit; a shaft rotatably coupled to and concentric with the sprocket, the shaft having a front side extending to the front of the sprocket and a rear side extending to the rear of the sprocket; and a belt rotatably coupling the drive shaft to the sprocket, wherein a first portion of the belt is disposed within the interior belt void of the first strut and a second portion of the belt is disposed within the interior belt void of the second strut.

DETAILED DESCRIPTION

Figure 1:
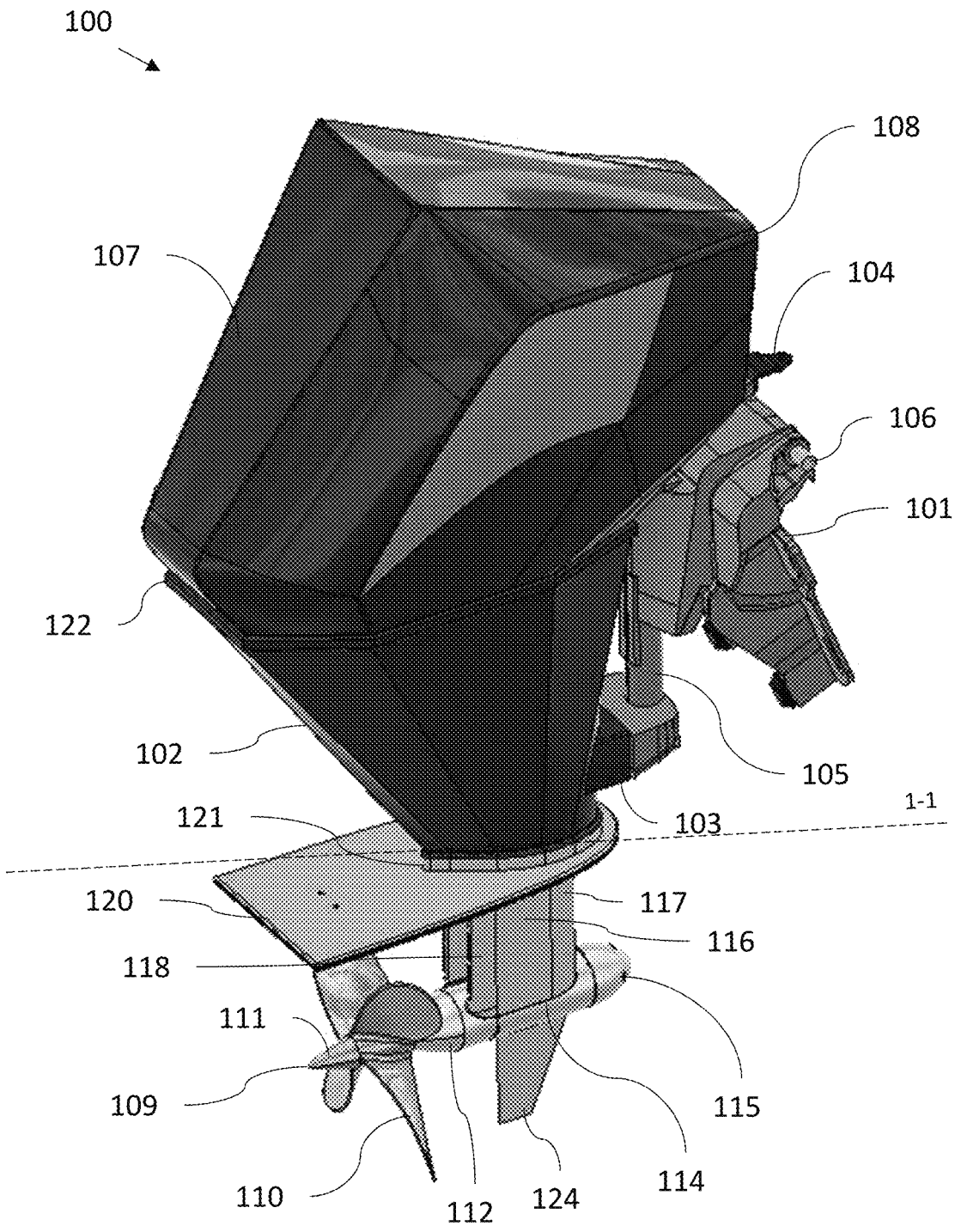
FIG. 1 illustrates an isometric view of an outboard motor according to embodiments of the present disclosure.

The powertrain of an outboard motor generally includes a prime mover, such as a combustion engine or electric motor, a vertical drive shaft, bevel gear, clutch, and propeller shaft (to which a propeller is attached). Bevel gears are gears between two intersecting shafts where the tooth-bearing faces of the gears are conical in shape. Bevel gears offer higher efficiency than other gear options and may allow for a gear reduction between the intersecting shafts. A clutch is used to allow the prime mover to operate in a single direction but also may allow the propeller shaft to rotate in both clockwise and counterclockwise directions. In various embodiments, outboards may use a dog clutch to switch between forward, neutral and reverse. This requires engaging and disengaging the shifting gears, leading to expedited wear on the teeth of the gear. To minimize this wear, the entire assembly may be submerged in an oil or lubricant that can be harmful to the environment and difficult to dispose of. Heat dissipation from key components including but not limited to, the prime mover, gears and bearings may be integral for reliable operation of this type of outboard motor. Outboard motors may ingest fluid (e.g., sea water) from the body of fluid (e.g., the sea) in which it operates to circulate the fluid around the system and cool components. However, this external fluid intake can bring in contaminants, including but not limited to salt, sand, and/or dirt that can expedite the wear and corrosion process. In some embodiments, the prime mover may be housed within the lower unit, below the water line. This configuration brings advantages with simplicity but may limit heat transfer capability. In various embodiments, other means of power transmission in place of a vertical drive shaft and bevel gears include, for example, chain-driven and belt-driven systems. In various embodiments, synchronous belts may be strong and durable, enabling potential use in higher power marine engine transmissions. In various embodiments, implementation of such belt or chain technologies may present challenges in physical housing arrangements and mechanical assembly as frontal area and hydrodynamic shape of submerged portions of marine propulsion systems greatly affects system drag and efficiency.

Accordingly, marine propulsion systems are needed that are optimized for belt-driven and chain-driven motors while reducing drag (e.g., improving hydrodynamic qualities) and improving heat dissipation. Embodiments of the present disclosure are intended to address the above challenges as well as others.

In various embodiments, a sterndrive or outboard marine propulsion system includes a prime mover that transmits power to a driven shaft through a synchronous belt, an anti-ventilation plate, a lower unit housing, one or more skegs extending from the bottom of the lower unit housing, and a set of struts (e.g., two struts) that connects the lower unit housing to the anti-ventilation plate and attachment point on the cowling (and/or frame structure within the cowling). In various embodiments, the set of struts may be substantially aligned (e.g., parallel) with one another. In various embodiments, each strut may include one or more (e.g., a plurality) of removably attachable and modular trailing edge pieces. In various embodiments, removably attachable trailing edge pieces may allow for fine tuning of hydrodynamic properties.

In various embodiments, the attachment point connects the midsection to the lower unit and prime mover in the embodiment of an outboard marine propulsion system or connects the lower unit and outdrive in the case of a sterndrive marine propulsion system. In various embodiments, particular variables of the system enable lower drag, higher performance, and efficient accommodation of belt drive technologies. In various embodiments, components of the marine propulsion system may be modular, replaceable, and/or built such they have integrated cooling channels. In various embodiments, integration of heat dissipation functionality into a multi-strut (e.g., dual-strut) architecture may provide increased surface area from the multiple struts to optimize heat transfer capability. In various embodiments, multiple struts (e.g., two struts) increases the surface area of the struts in contact with water, thereby improving heat transfer (e.g., conduction) with the water (similar to the heat transfer of fins).

In various embodiments, frontal area and hydrodynamic shape of submerged portions of marine propulsion systems may affects system drag and efficiency. Reducing the drag on a marine propulsion system has direct improvement on the net efficiency of the system. In various embodiments, as the set of struts may be submerged when in use, the set of struts may have any suitable hydrodynamic shape to thereby reduce and/or optimize drag. For example, each strut may include an airfoil shape where the leading edge of the airfoil corresponds to the leading side of the strut.

When in operation, a belt generally has a tight side and a slack side. In various embodiments, the belt may be isolated (i.e., sealed) from the surrounding body of water in which the motor operates. In various embodiments, both sides of the belt may be supported to provide tension to the belt. In various embodiments, providing tension to the belt may reduce (e.g., stop) contamination from the surrounding water. In various embodiments, the marine propulsion system may include, among other things, a continuous loop power transmission device. For example, the prime mover may be mechanically (e.g., rotationally) coupled to the propeller via a belt or chain.

In various embodiments, each strut may be positioned at a predetermined distance from one another to thereby allow fluid flow between the struts. For example, in a dual-strut arrangement, the struts may be positioned about 2 to about 24 inches from one another. In various embodiments, the struts may be positioned about 1.5 to 6 inches from one another. In various embodiments, in larger applications (e.g., yachts, tugboats, etc.), the struts may be positioned several feet apart. In various embodiments, the struts may be positioned up to about 12 feet apart. In various embodiments, the spacing of the struts may be dependent on one or more performance factors, such as, e.g., (1) hydrodynamic interactions between the struts and/or (2) hydrodynamic drag of the lower unit. In various embodiments, as struts become wider, fewer fluid interactions may occur between the multiple struts (interference). In various embodiments, wider struts may improve certain performance factors. In various embodiments, the size (e.g., drag area) of the lower unit may be minimized to thereby minimize drag. In various embodiments, the size of the lower unit may be minimized by providing a small frontal area of the lower unit. In various embodiments, the size of the lower unit may be proportional to the size of the struts. For example, for wider struts, a larger lower unit may be provided. In various embodiments, the struts may not be parallel. For example, the struts may be non-linear or disposed at an angle (e.g., a 'V' shape) with respect to the horizontal (sea level).

In various embodiments, each strut may include a cross-sectional profile of the vertical struts that minimizes the drag through water. In various embodiments, the cross-sectional profile may reduce (e.g., minimize) the drag area while allowing for enough void space to house the continuous loop (e.g., belt or chain). In various embodiments, each strut may include an airfoil shape. In various embodiments, any struts (e.g., some or all struts) may have a substantially uniform shape along its length. In various embodiments, any struts (e.g., some or all struts) may have a varying shape along its respective length. For example, a strut may taper, from the leading to trailing edges, from a wider airfoil (having a higher drag area) to a thinner airfoil (having a lower drag area) or vice versa. In various embodiments, any struts (e.g., some or all struts) may have a substantially uniform width (in the direction of flow) along the length of the strut. For example, an airfoil shape may have a substantially similar (e.g., equal) chord length and/or camber line along the entire length of the strut. In various embodiments, any struts (e.g., some or all struts) may have a varying width (in the direction of flow) along the length of the strut. For example, an airfoil shape may have a varying chord length and/or camber line along the entire length of the strut. The struts can have mirroring shapes that are symmetrical about a central axis passing through the struts; alternatively, each strut can be formed with a unique shape/profile relative to the adjacent strut.

In various embodiments, each strut may include separate void spaces configured to house each side of the continuous loop (i.e., the slack side and the taut side). In various embodiments, the separate void spaces within either one or all of the vertical struts may be configured to transfer fluid (e.g., a heat transfer fluid) throughout the outboard.

In various embodiments, one or more of the struts may include a parting line to thereby separate the strut into two or more pieces. In various embodiments, parting lines allow for ease of access so that a continuous loop (e.g., chain or belt) may be installed or removed during or after manufacture (e.g., for repairs). The parting line(s) can be extend along the entire portion of the strut (e.g. between nosecone and anti-ventilation plate).

FIG. 1 illustrates an isometric view of an outboard marine propulsion system 100. In various embodiments, the marine propulsion system 100 (e.g., an outboard motor) may include a powerhead section, prime mover cowling, belt drive, anti-ventilation plate, dual strut transmission housing, lower unit with propeller, and skeg. In various embodiments, the outboard marine propulsion system 100 includes a mount 101 configured to releasably couple the transom of a boat to the outboard midsection 102 via a transom mount pad 103. In various embodiments, the outboard motor may be steered through a variety of methods, including but not limited to cables, pulleys, hydraulic and/or electromechanical actuators that mount to the steering bracket 104 and rotate the outboard motor around an axis of the steering tube 105. In various embodiments, the angle of the outboard motor, and thus the angle of propulsion, can also be controlled around the tilt axis 106. In various embodiments, the prime mover components, whether electrically or liquid fuel powered, are located underneath the top cowling 107. In various embodiments, a side of the cowling 107 facing the transom of the boat may include a face plate 108. In various embodiments, the drive shaft of the prime mover is connected via a synchronous drive belt (not shown) to the propeller shaft 109. In various embodiments, the synchronous drive belt, in turn, drives the propeller 110, creating momentum to propel the boat on which the marine propulsion system 100 is affixed. In other embodiments, the propeller may be replaced by an impeller, waterjet, or other propulsive device. In this embodiment, a propeller tailcone 111 and tail fairing 112 match the geometric profile of the propeller to minimize turbulent losses and maximize efficiency. In other embodiments, the propeller tailcone 111 and tail fairing 112 shapes can be adjusted to match different propellers. A sprocket (disposed inside the lower unit) is concentrically mounted to the propeller shaft 109 and housed inside the lower unit 114. In various embodiments, the lower unit 114 may include a nosecone 115 on a leading portion thereof. The one or more struts 116 provide an open pathway for the belt to transmit power from a sprocket attached to the prime mover under the top cowling 107 to the sprocket on the propeller shaft 109. The separate struts 116 bodies allow for the belt to operate without additional rolling components, enabling the highest possible efficiency. The one or more struts 116 are spaced in such a way that the belt does not need to be guided around obstacles or shapes as it has been required to do so in prior art. The strut bodies have hydrodynamic strut leading edges 117 and strut trailing edges 118 that reduce drag and maximize laminar flow to the propeller 110. The struts 116 connect to the anti-ventilation plate 120, which is fastened to the midsection bottom collar 121. This, in turn, fastens to the bottom of the midsection. In various embodiments, a midsection top collar 122 may provide an interface between the midsection 102 and the top cowling 107. In various embodiments, one or more skeg 124 is disposed below the lower unit. In various embodiments, where two or more skegs are provided, each skeg may be positioned equiangularly around the lower unit 114, and located upstream of the propeller.

Figure 2:
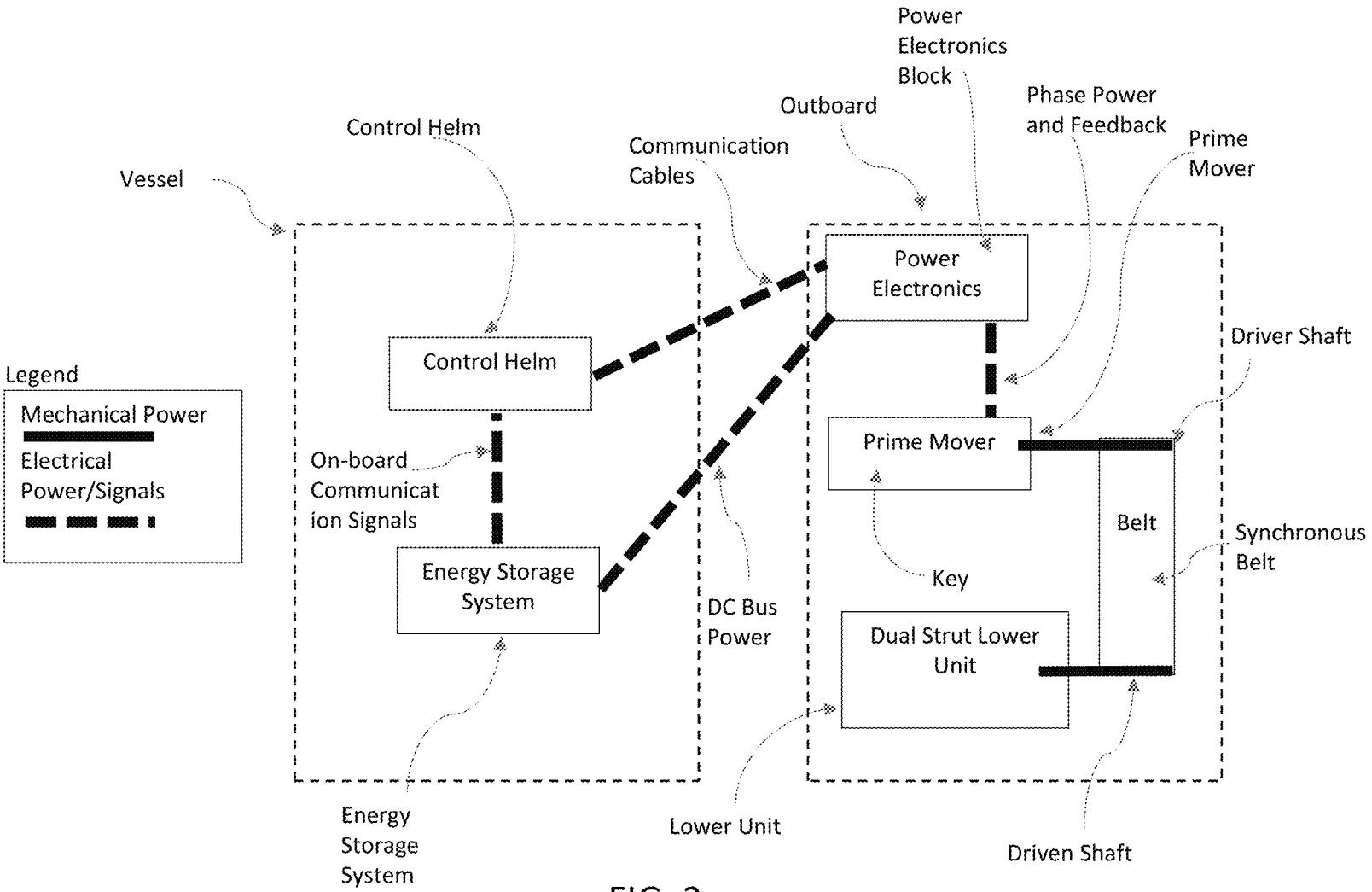
FIG. 2 a block diagram representing component level interactions between the propulsion system as a whole and the dual strut lower unit according to embodiments of the present disclosure.

FIG. 2 illustrates a block diagram 200 representing component level interactions between the propulsion system as a whole and the dual strut lower unit. Component blocks are generally located in either the vessel or in the outboard, and are connected either mechanically or electrically as indicated by the legend. In various embodiments, the operator controls the system via the control helm, which uses onboard communication signals to interface with the energy storage system and additional communication cables to interface with the power electronics in the outboard. Communication protocols including, but not limited to, serial, CANbus, SPI, analog, and digital could be used. In various embodiments, the Energy Storage System is connected to the power electronics block through a DC Bus. In various embodiments, the DC bus may range from 12V to over 900V. In various embodiments, the power electronics block generally encompasses all power stage and control components required to use DC voltage to drive a prime mover. In various embodiments, based on signals from the control helm, the power electronics may pull energy from the Energy Storage System through the DC Bus and control the prime mover. In various embodiments, the prime mover may be an electric motor, through Phase Power and Feedback signals. In various embodiments, the prime mover is mechanically coupled through a driver shaft to the synchronous belt. In various embodiments, the belt rotates a driven shaft located inside the lower unit to thereby power a propeller.

Figure 3:
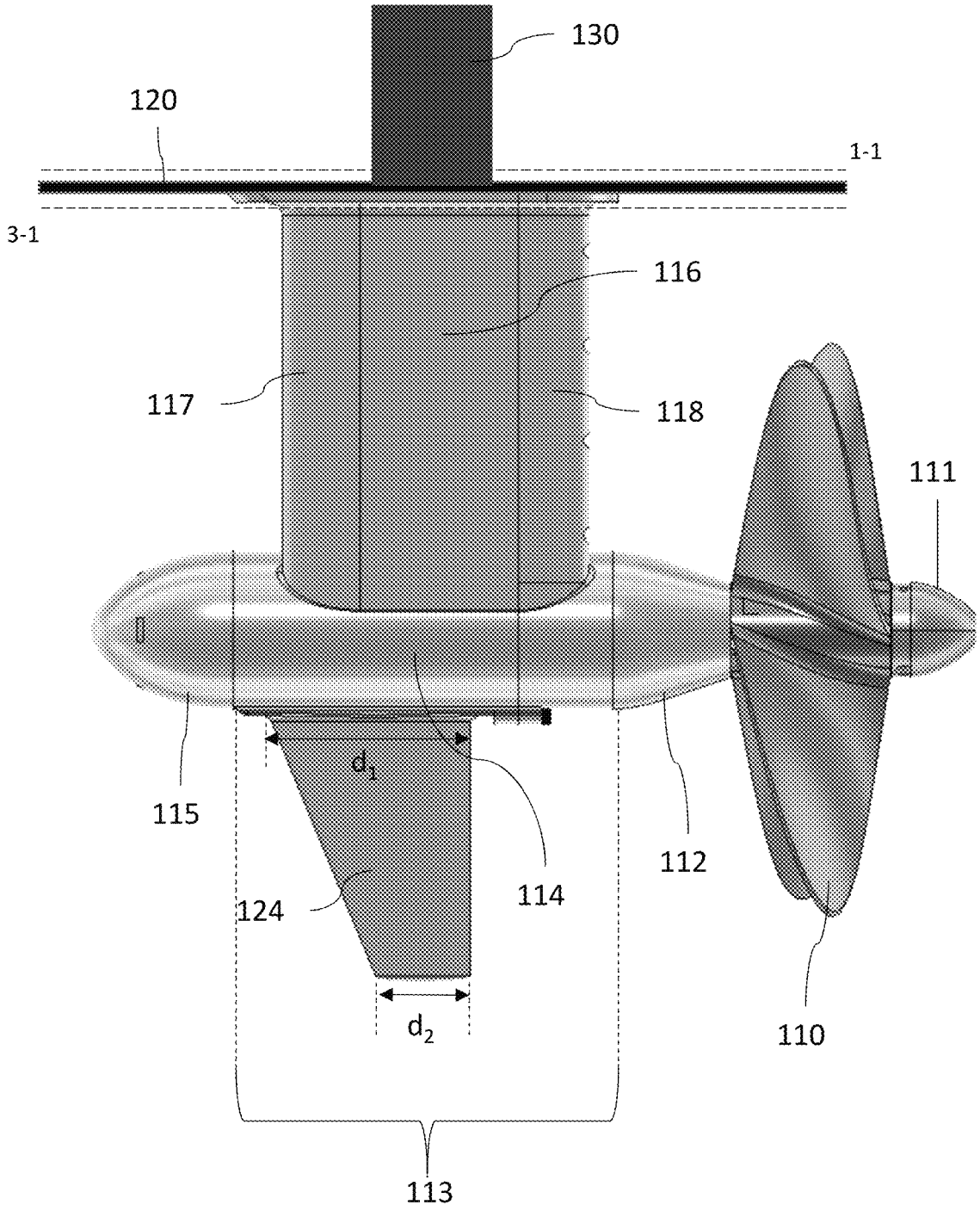
FIG. 3 illustrates a partial side view of the dual strut and lower unit bullet architecture taken generally below the line 1-1 of FIG. 1 according to embodiments of the present disclosure.

FIG. 3 illustrates a partial side view of the dual strut and lower unit bullet architecture taken generally below the line 1-1 of FIG. 1. Line 1-1, in some embodiments, is the water line of the outboard during operation. When in operation, all components below the waterline 1-1 are submerged and contribute to the hydrodynamic drag of the system. As described in the background, sterndrives and outboard marine propulsion systems may use single strut housings that connect gearcases to powerheads. Additionally, nearly all combustion outboards use a shaft and bevel gear system to transmit power from the combustion or electric powerhead to the propeller. In that type of lower unit, a mechanical mechanism is required for switching from forward to neutral to reverse. This type of power transmission requires consistent maintenance for lubricating the gears, wears quickly because of shifting at non-zero rotational speed, and may result in a 15% efficiency loss. The bevel gears also generate significant noise.

Recent advancements in material technologies have enabled the development of more robust synchronous belt drives which have the potential to increase efficiency, decrease noise, reduce maintenance, and lower cost. The present disclosure enables the use of a synchronous belt in a marine propulsion system, through a multi-strut body arrangement where each side of the belt travels through a different strut. Additionally, the present disclosure also provides a method for using electronic reversing from an electric prime mover, thereby eliminating the need for a complex mechanical shifting solution.

In various embodiments, the multi-strut design minimizes fluid flow obstruction to the propeller while moving. In various embodiments, the multi-strut (e.g., dual-strut) design reduces drag-inducing frontal area (i.e., the drag area) while increasing robustness of the entire system. In various embodiments, the strut 116 and anti-ventilation plate 120 interface is integrally formed. In various embodiments, the strut 116 and anti-ventilation plate 120 interface is mechanically fastened (e.g., with bolts and nuts). In various embodiments, the bottom of the struts may be integrally formed with the lower unit 114. In various embodiments, the lower unit 114 may be bullet-shaped (a bullet+bullet casing). In various embodiments, a first portion (e.g., the taut side) and a second portion (e.g., the slack side) of a synchronous belt 130 is protected from water and/or external fluids inside a void space within first and second struts 116. Thus the belt 130 extends (vertically when in operation) through the first strut 116, into the lower unit 114, where it engages and drives the propeller 110 forward/reverse), and up through the second strut 116, and back into the cowling 107.

In various embodiments, drag may be reduced through hydrodynamic shapes applied to the leading edges 117 and trailing edges 118 of the struts 116. In various embodiments, convex surfaces on the sides of the struts 116 between the leading edges 117 and the trailing edges 118 reduce form drag and wave creation. In various embodiments, the profile of the convex surfaces does not have to be symmetric between struts and could be changed for different applications (i.e., not all struts have to be identical in shape). In various embodiments, struts 116 may be reflections of one another (e.g., a first strut may be a reflection of a second strut). In various embodiments, the sides of the struts 116 may be substantially parallel and of equivalent lengths. In various embodiments, the struts could be non-parallel. In various embodiments, the space between the struts may increase or decrease over the height of the struts.

In various embodiments, the sides of the struts 116 may have no concavity. In various embodiments, the leading edges 117 can be integrally formed with the strut 116. In various embodiments, the leading edges 117 may be separately manufactured and removably fastened to the strut 116. In various embodiments, the trailing edges 118 may be integrally formed with the strut 116. In various embodiments, the trailing edges 118 may be separately manufactured and removably fastened (e.g., with a screw, bolt, etc.) to the strut 116 via, for example, a strut attachment point. In various embodiments, the leading edges 117 and/or the trailing edges 118 may be modular and swappable for performance optimization. Additionally or alternatively, the strut(s) can include an access panel to allow repair and inspection of the belt. The access panel can be spaced from the leading/trailing edge and located within the generally planar section of the strut(s).

In various embodiments, the strut(s) may include active control of surface shapes of the leading and/or trailing edges during operation. For example, an electronic control (e.g., real time or manual) may change a camber or chord length of an airfoil shape. In another example, an electronic control (e.g., real time or manual) may change a width (e.g., drag area) of an airfoil shape such that the continuous loop (e.g., belt) has enough room to operate in the void space.

Further aiding in hydrodynamic drag reduction and increasing propulsive efficiency is the overall shape of the architecture. In various embodiments, incoming fluid flow interacts with the nosecone 115 first. In various embodiments, the nosecone 115 geometry may be designed with a smooth transition from the nosecone 115 over the nosecone/lower unit interface and to the lower unit 114. In various embodiments, the nosecone 115 is removable and swappable. In various embodiments, the nosecone 115 may include any suitable shape. For example, the nosecone 115 may include a blunt bullet-like shape. In various embodiments, a middle portion 113 of the lower unit 114 may have a substantially cylindrical shape (e.g., a bullet casing shape). In another example, the nosecone 115 may be substantially conical with a sharper point. In various embodiments, as fluid flow passes the lower unit 114, the tail fairing 112 may minimize loss-inducing boundary layer separation over the tail fairing/lower unit interface as boundary layer separation may cause turbulent flow thus increasing pressure drag on the propulsion system 100. In various embodiments, the tail fairing 112 is shaped such that the tail fairing/propeller hub interface hydrodynamically meshes with the propeller hub to optimize flow entering the propeller. Thus, the struts 116, lower unit 114, nose cone 115 and tail faring 112 can be configured with a virtually seamless design in which there are no abrupt changes in size/shape/diameter, with the assembly of these components forming a continuous outer surface area to minimize drag.

In various embodiments, the tail fairing may be a frustoconical shape tapering from a larger diameter at the middle portion 113 to a smaller diameter at the propeller 110. In various embodiments, as the propeller 110 spins and generates regions of high and low pressure, flow is directed over a propeller tailcone 111 to reduce turbulent flow and thus further minimize drag on the propulsion system 100. In typical combustion-type marine engines, engine exhaust is generally directed down through a singular piece and out through the center of the propeller. The present disclosure eliminates this style of exhaust and allows for a more efficient overall hydrodynamic approach.

In various embodiments, one or more skeg 124 may be attached to the middle portion 113 of the lower unit 114. In various embodiments, the middle portion 113 may include one or more skeg attachment points configured to allow attachment of one or more skegs 124. In various embodiments, the skeg 124 may have a generally fin-like shape. In various embodiments, the skeg 124 may have a constant thickness along its length. In various embodiments, the skeg 124 may have a varying depth along its length. For example, the skeg 124 may taper from a first, larger depth, $d_1$, to a second, smaller depth, $d_2$. In various embodiments, one side of the skeg 124 may be vertical while the other side tapers. In various embodiments, both sides of the skeg 124 may taper. In various embodiments, the skeg 124 may have an curvilinear or airfoil shape, similar to the struts 116. In various embodiments, the skeg 124 is removable and replaceable at the skeg/lower unit interface. In various embodiments, the skeg 124 can be integrally formed at the skeg/lower unit interface. In various embodiments, the skeg 124 contributes to stability and hydrodynamic flow interaction by having a trailing edge that minimizes flow disturbances going into the propeller 110. In various embodiments, the bottom-most edge of the skeg 124 may be lower than the blades of the propeller 110, providing protection to the propeller 110 from physical object strikes. Additionally or alternatively, the location of the skeg 124 can be adjusted up/down stream relative to the lower unit 114.

Figure 4:
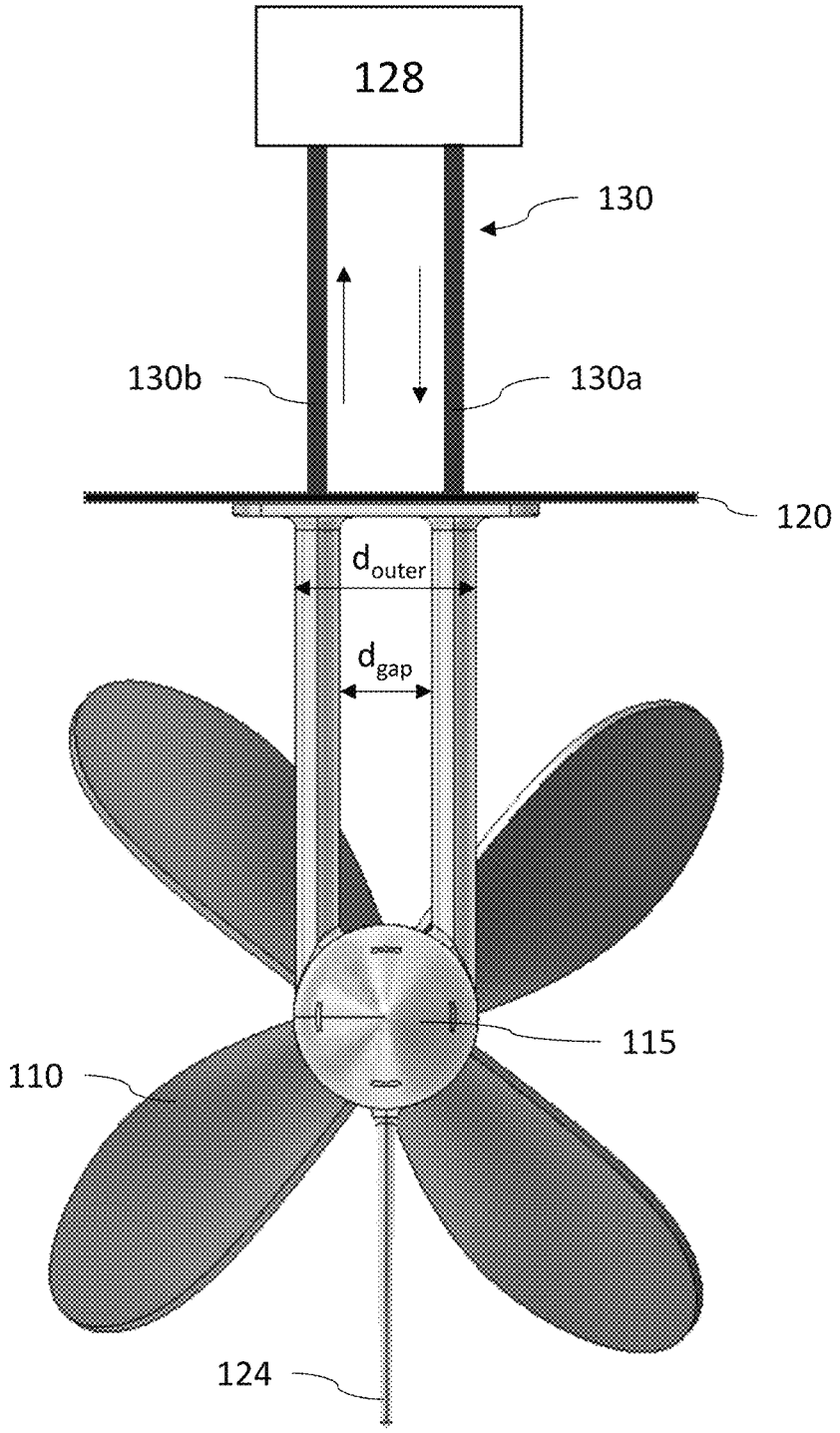
FIG. 4 illustrates a partial front view taken generally below the line 1-1 of FIG. 1 according to embodiments of the present disclosure.

FIG. 4 illustrates a partial frontal view taken generally below the line 1-1 of FIG. 1. As shown in FIG. 4, the prime mover 128 is rotationally coupled to the belt 130 via a drive shaft (not shown). As the prime mover rotates, either the left side 130*a* of the belt 130 or the ride side 130*b* of the belt 130 may transmit rotational force to and from the propeller. In the example shown, where the belt 130 is rotating counterclockwise (from the viewpoint of the prime mover 128), the left side 130*a* of the belt is the slack side and the right side 130*b* of the belt 130 is the taut (i.e., in tension) side. In various embodiments, the width of the gap between the two struts 116 (as measured by the distance between the inside edges of each strut) allows for passage of fluid (e.g., sea water) and can be changed to accommodate larger or smaller overall component dimensions, while keeping the ride side 130*b* of the belt 130 and left side 130*a* of the belt 130 parallel with one another. In various embodiments, the distance, $d_{gap}$, between the inside edges of the struts 116 can be varied based on ideal performance metrics, e.g., to reduce frontal (drag) area. In various embodiments, the distance, $d_{outer}$, between the outside edges can also be varied, for example, to accommodate thicker pitched belts. In various embodiments, the strut/lower unit interface may have a gradual, hydrodynamic shape to minimize flow disturbances as water travels through the struts 116 to the propeller 110. In various embodiments, the propeller 110 may be placed in front of the struts 116. In various embodiments, the anti-ventilation plate 120 may connect to the top (i.e., a proximal end) of the struts 116 and may prevent the propeller from sucking air from the surface. The anti-ventilation plate may be referred to colloquially as a "cavitation Plate". The upper end of struts 116 can connect directly to the cowling 107; additionally or alternatively, the upper end of struts 116 can connect to a mounting plate/frame which receives the cowling 107.

Figure 5:
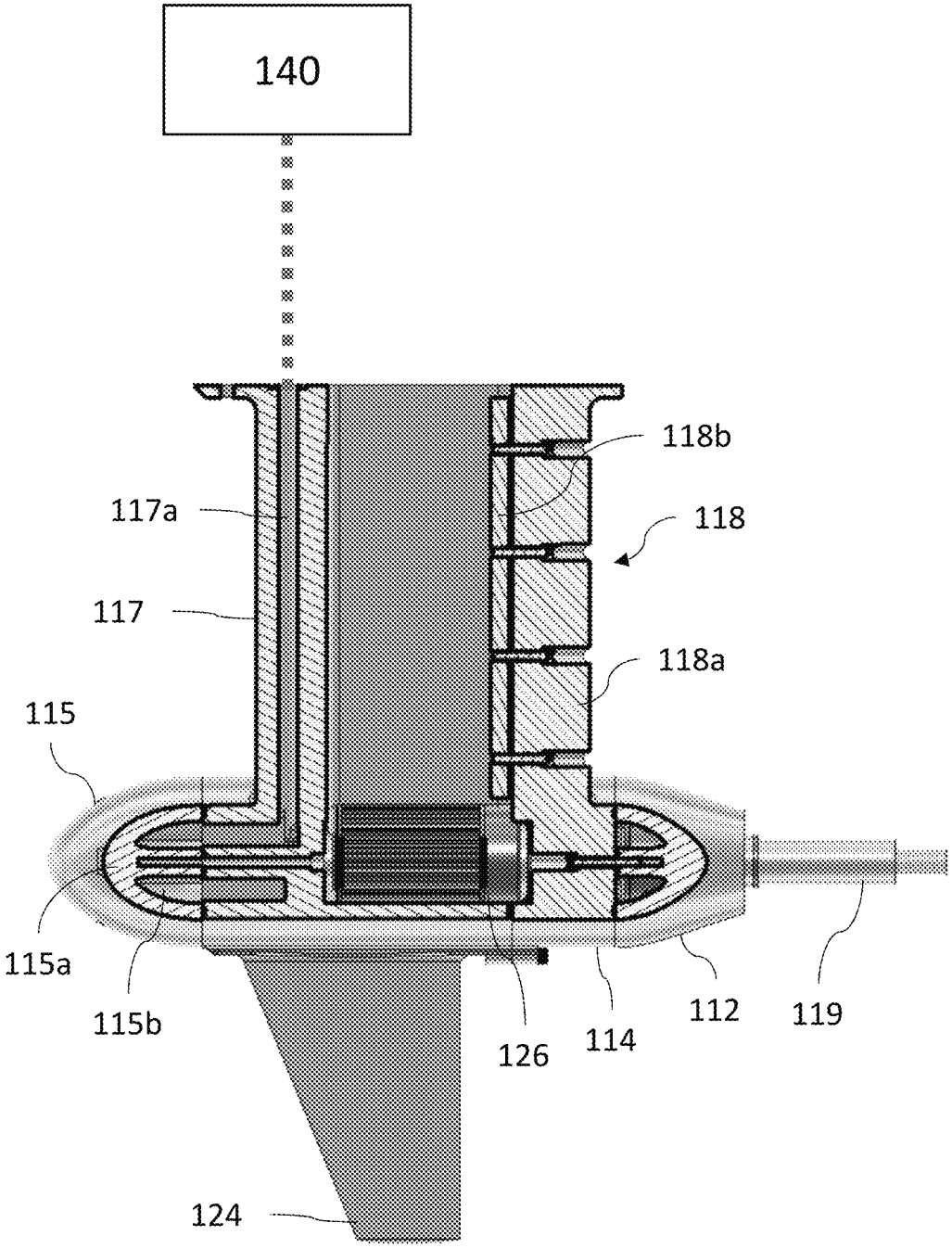
FIG. 5 illustrates a cross-sectional side view taken generally below the line 3-1 of FIG. 3 according to embodiments of the present disclosure.

FIG. 5 illustrates a partial side view, partially in section, taken generally below the line 3-1 of FIG. 3. In various embodiments, the sprocket 126 is concentrically fixed to the propeller shaft 119, which exits the lower unit bullet through the tail fairing 112. In various embodiments, the inside of the lower unit 114 is protected from sea water through seals on all edges and interfaces, including a set of shaft seals. In various embodiments, both leading edges 117 of the struts 116 contain coolant passages 117*a* to allow coolant to flow therethrough. In various embodiments, coolant can enter each strut through a coolant port, then flow through the coolant passages 117*a*, which removes heat from the coolant through conduction. Thus, the present disclosure provides a closed-circuit fluid cooling system, wherein the coolant circulation path is retained within the struts 116, nose cone 115 and anti-ventilation plate 120. Thus the coolant system does not need to rely on the intake of ambient water when in operation. In various embodiments, the coolant passage(s) 117*a* of each strut allows coolant to flow into a nosecone void 115*a*, which acts as a submerged, heat rejecting reservoir. In various embodiments, the nosecone void 115*a* contains one or more nosecone turbulators 115*b* (e.g. undulating structure/wall/strip) configured to increase turbulence of the heat transfer fluid and thus increase heat rejection capacity. Optionally, coolant passages 117*a* can extend throughout the anti-ventilation plate 120.

In various embodiments, coolant can flow bi-directionally through the struts 116 and to the thermal circuit 140 via the coolant passage 117*a*. In various embodiments, the coolant passage 117*a* may comprise tubing, hosing, pipes, and/or other methods of fluid transfer. In various embodiments, the thermal circuit may include an electronic controller pump and/or heat producing components including but not limited to the power electronics and prime mover. In various embodiments, a set of coolant port seals ensures the heat transfer fluid does not become contaminated. In various embodiments, additional voids may be provided in the trailing edge(s) 118, belt accommodation void 131, tail fairing 112, and/or lower unit 114 that can be used for additional coolant passages. In various embodiments, the longitudinal width of the belt accommodation void 131 can be varied for belts of different sizes. In various embodiments, the trailing edge 118 may be mechanically fastened by a set of trailing edge fasteners 118*a* configured to anchor into an anchor panel 118*b* (e.g., a T-block). In various embodiments, this method of attachment allows the trailing edges 118 to be separated from the struts 116 for installation and removal of the belt 130. In various embodiments, the belt accommodation void 131 may be optimized such that the size (e.g., width of the void space) of the void is minimized. In various embodiments, less void space may be better from a hydrodynamic standpoint (e.g., less drag area). In various embodiments, the belt accommodation void 131 may be about 1/8 inch on either side of the belt 130. In various embodiments, the sprocket gap 125 may have a similar 1/8" gap. In various embodiments, the sprocket gap 125 may be smaller than the space between the belt 130 and an interior side of the belt accommodation void 131 as the belt may not have as much motion around the sprocket 126. In various embodiments, the belt accommodation void 131 may include a spacing (e.g., width) of about 0.01 inch to about 0.25 inch on either side of the belt. For example, 0.25 inch on either side of the belt 130 would result in 0.25 in+0.25 in+belt thickness (in inches) for the total width of the belt accommodation void 131. In various embodiments, the belt accommodation void 131 may include a spacing (e.g., width) of about 0.01 inch to about 6 inches on either side of the belt. In various embodiments, the spacing may scale with system size. In various embodiments, the spacing (e.g., width) may be about 12 inches on either side of the belt.

Figure 6:
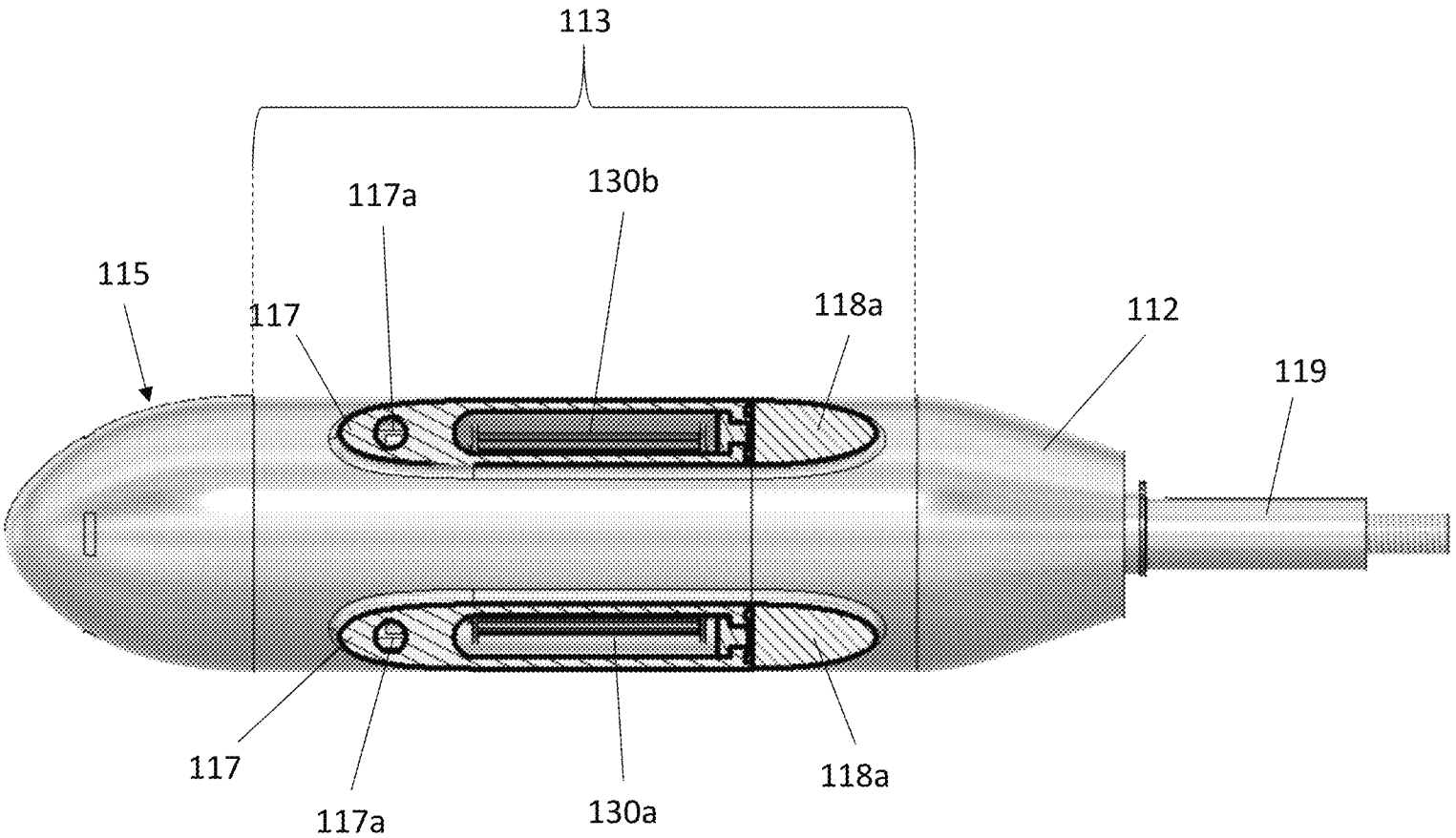
FIG. 6 illustrates a cross-sectional top view taken generally below the line 3-1 of FIG. 3 according to embodiments of the present disclosure.

FIG. 6 illustrates a partial top view, partially in section, taken generally below the line 3-1 of FIG. 3. In various embodiments, the nosecone 115 has an outer contour that maintains an attached flow (e.g., reduces/prevents boundary layer separation) with the surrounding fluid body. In various embodiments, the nosecone 115 has a conical shape. In various embodiments, the nosecone 115 may be blunt or rounded at the tip. In various embodiments, the contour can be changed to suit different operating conditions. In various embodiments, the lower unit 114 may be cylindrical in shape and connected to both struts. In various embodiments, the trailing edges 118 may be connected to the struts 116 through fasteners anchored into the T-block 118*b*. In turn, the T-block is held by the walls of the dual strut bodies. In various embodiments, the leading edges 117 may include a coolant passage 117*a* having a circular diameter. In various embodiments, the coolant passage 117*a* may have a substantially constant diameter throughout the thermal circuit 140.

Figure 7:
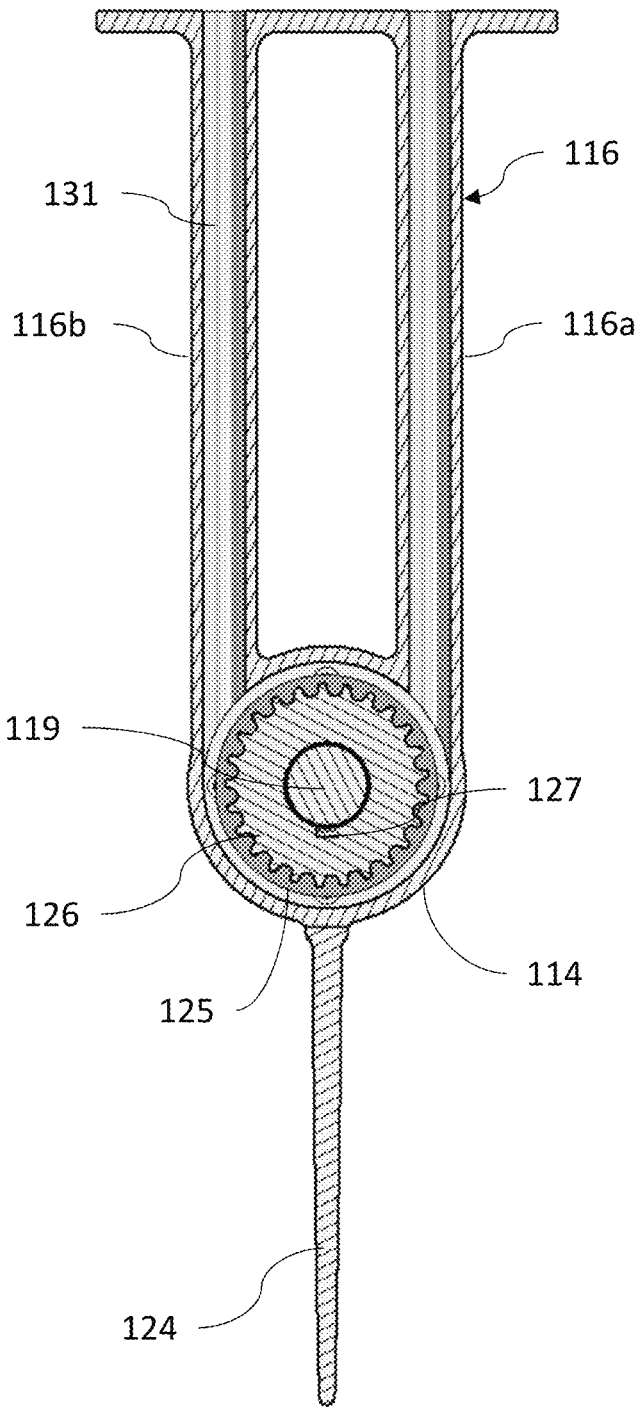
FIG. 7 illustrates a cross-sectional front view taken generally below the line 3-1 of FIG. 3 according to embodiments of the present disclosure.

FIG. 7 illustrates a partial frontal view, partially in section, taken generally below the line 3-1 of FIG. 3. As shown in FIG. 7, the lower unit 114 and struts 116 include a belt accommodation void through which the belt 130 may pass. In various embodiments, the struts 116 include a strut inside wall and strut outside wall. In various embodiments, the strut inside wall and strut outside wall may be made of any suitable material, and can, but are not required, to be integrally formed with the rest of the strut body. In various embodiments, the thickness of the strut walls may be selected based on the application, either to increase robustness or decrease drag. In various embodiments, within the lower unit 114, the belt-driven sprocket 126 is concentric with the propeller shaft 119. In various embodiments, a keyway 127 is used to transmit torque between the sprocket 126 and propeller shaft 119. In various embodiments, a spline could be used or the sprocket 126 and propeller shaft 119 can be integrally formed. In various embodiments, to accommodate the thickness of the belt 130, an air-filled sprocket gap 125 exists in the lower unit 114. In various embodiments, due to the dual strut configuration, the belt 130 is able to rotate about the sprocket 126 without physically contacting any other part of the lower unit 114. In various embodiments, this contact-free operation allows for lubrication-free operation, compared to other motors which requires the belt or transmission components to operate in an oil-filled bath. The belt 130 can wrap around the sprocket 126, with engagement between respective surfaces over approximately 180 degrees of rotation of the sprocket. The sprocket 126 can include raised teeth, as shown, to increase the frictional engagement with the belt and generate greater torque.

Figure 8:
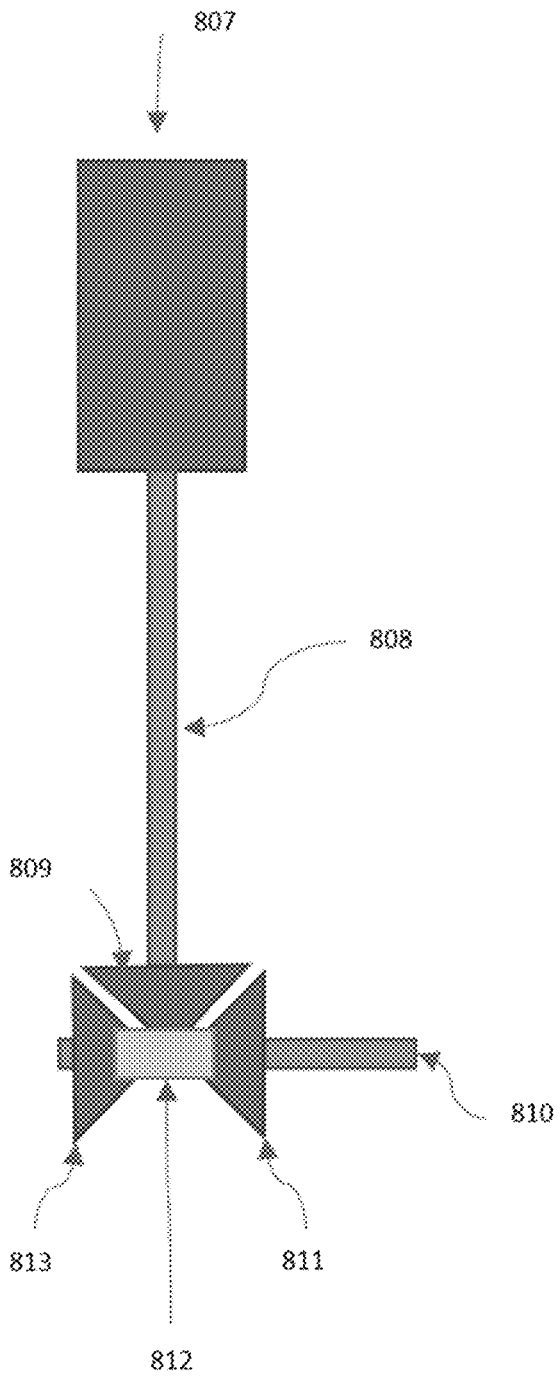
FIG. 8 illustrates a schematic representation of an outboard power transmission system according to embodiments of the present disclosure.

FIG. 8 illustrates a schematic representation of a traditional outboard power transmission system. In various embodiments, this utilizes a prime mover 807 with a vertically extending drive shaft 808. In various embodiments, power is transmitted from the vertical drive shaft and the horizontal prop shaft using gears. In various embodiments, a pinion gear is used 809 in conjunction with a crown gear 811 and 813 to transfer rotational velocity to the driven shaft. In many embodiments, a clutch is used with a sliding collar 812 that can engage either the clockwise or counter clockwise crown gear. In various embodiments, this mechanism enables a change in the rotation direction of the propeller shaft while maintaining drive direction of the prime mover.

Figure 9:
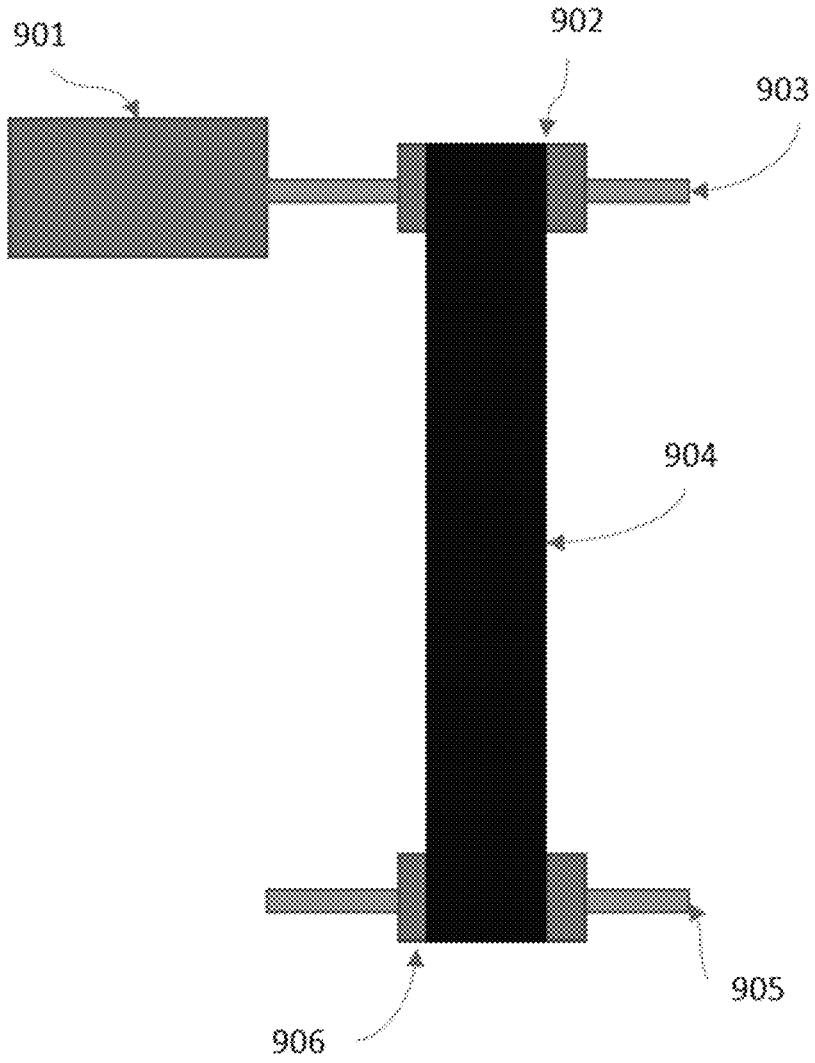
FIG. 9 illustrates a schematic representation of a belt-drive transmission system according to embodiments of the present disclosure.

FIG. 9 illustrates a schematic representation of a belt drive transmission system. In various embodiments, this is a schematic representation of a certain embodiment for an alternative means of power transmission between a prime mover 901 and the lower driven shaft 905. In various embodiments, the prime mover utilizes a drive shaft extending horizontally 903, supporting a sprocket or gear 902, capable of driving a belt to the lower sprocket or gear 906 via a continuous loop 904.

In various embodiments, any struts may include non-linear shapes. In various embodiments, to accommodate a non-linear shape, the belt may remain substantially straight, but and the width of the belt accommodation void 131 (space between the belt and inside walls of the strut voids) may vary. In various embodiments, the struts may include pulleys (e.g., roller pulleys) configured to create a curve for the belt 130 to follow. In various embodiments, low friction pads can be positioned at any suitable position within the belt accommodation void 131. In various embodiments, any combination of the above three methods could work together to achieve a non-linear strut shape. In various embodiments, the leading edge of the struts may include a non-uniform profile (viewing from the top-down).

The various components disclosed herein (e.g., struts, nosecone, fairing, skeg) can be formed from a variety of materials including metals (e.g., aluminum, steel, titanium, etc.) rigid polymers and plastics, wood, etc. In various embodiments, the various components may include composite materials (e.g., carbon fiber, fiberglass, etc.). In various embodiments, the various components may include rubber. In various embodiments, the various components may include thermoplastics. In various embodiments, the various components may include any suitable metal-based alloys. In various embodiments, the various components may include materials with high thermal conductivity and high corrosion resistance. In various embodiments, the various components may include one or more coatings (anodize, powder coat, chemical vapor deposition, paint, etc.). In various embodiments, the various components may be formed from more than one material (i.e., nosecone could be mostly aluminum with a rubber based tip).

Figure 10A:
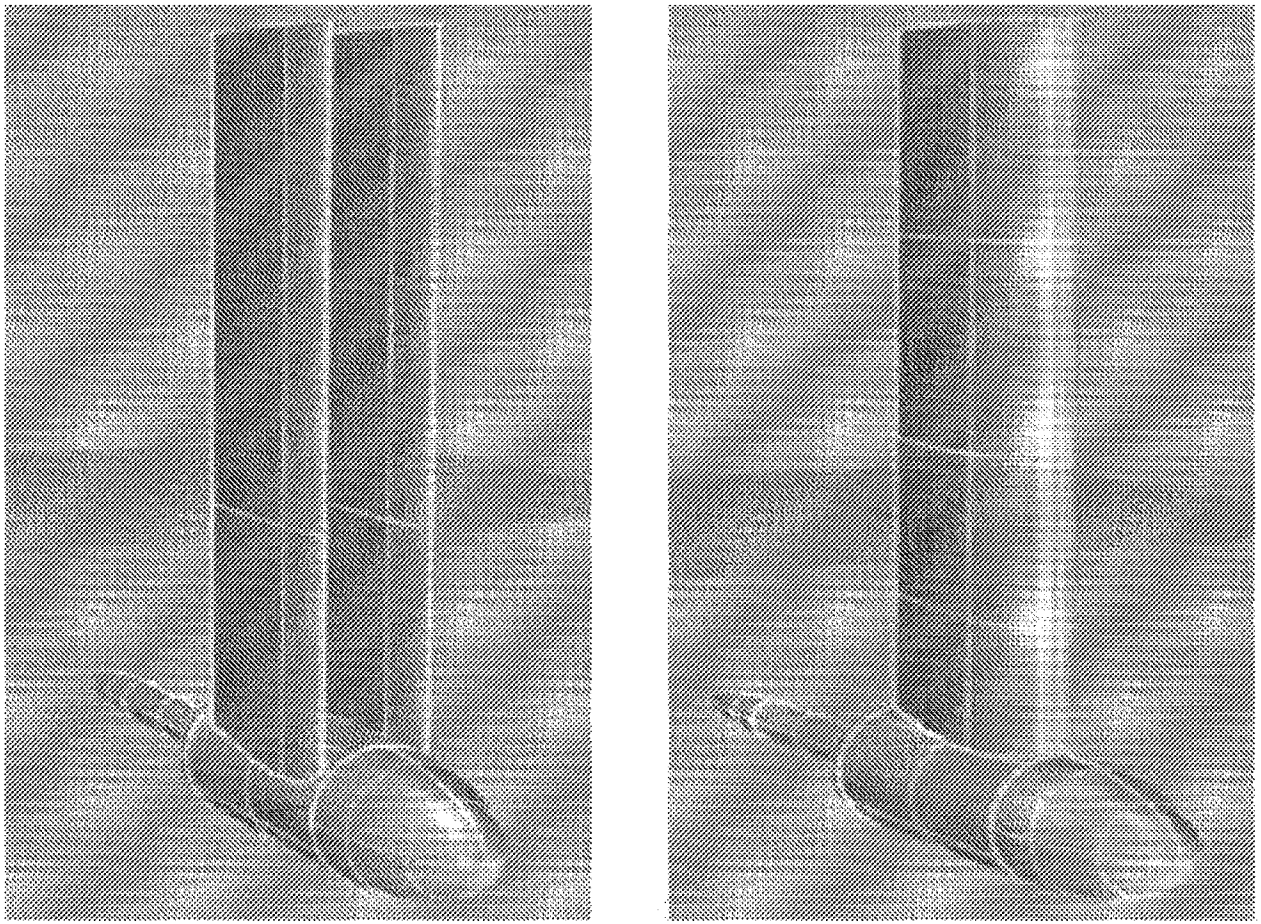
FIGS. 10A-10B illustrate a computational fluid dynamics visualization of a dual strut and a single strut according to embodiments of the present disclosure.
Figure 10B:
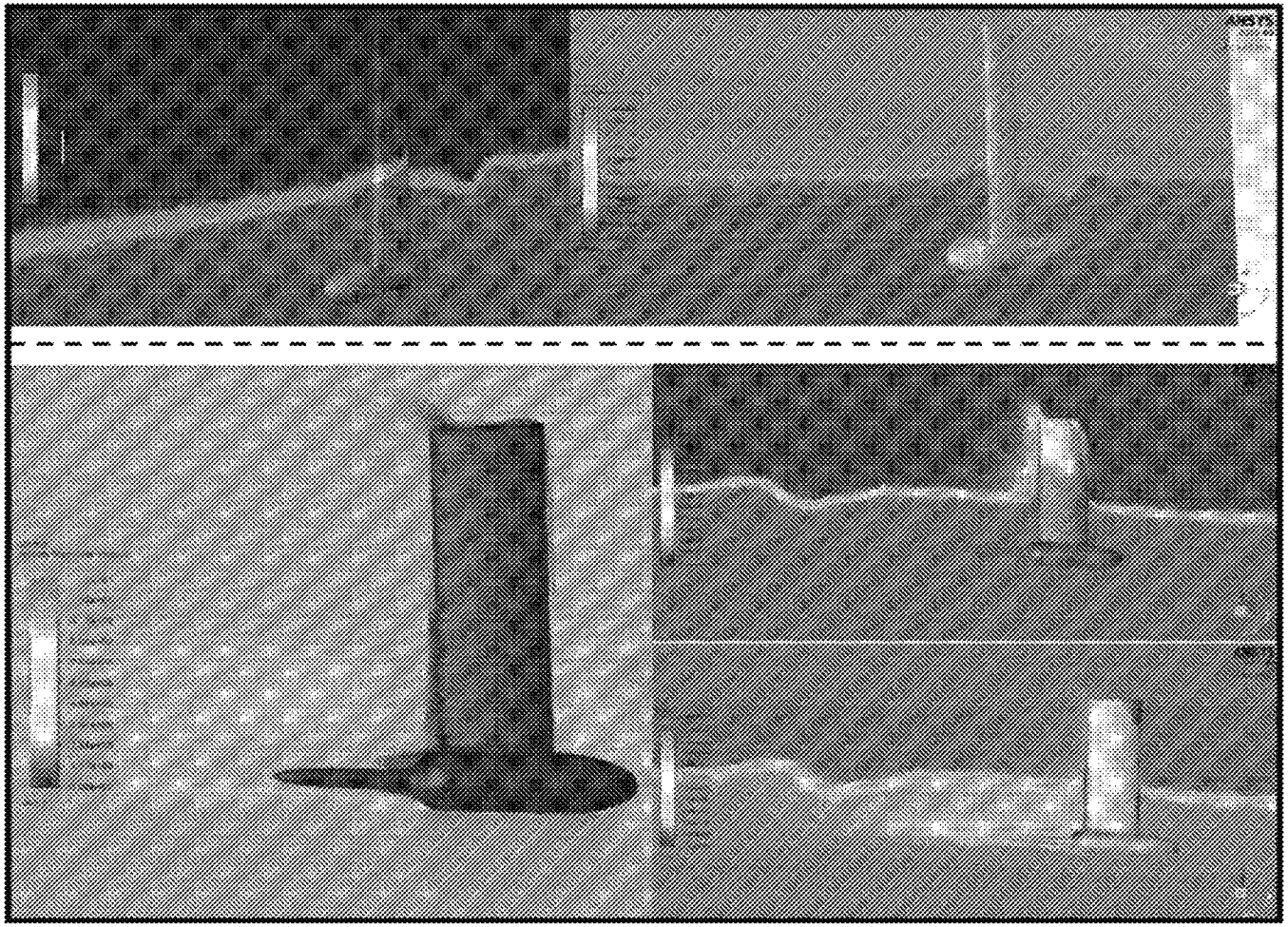

FIGS. 10A-10B illustrate a computational fluid dynamics visualization of the disclosed dual strut and a traditional single strut. In various embodiments, this half-body analysis was used to understand preliminary hydrodynamic effects and implications of a dual strut compared to a single strut. The plot of FIGS. 10A-10B shows a laminar flow as evidenced by the largely uniform shading of the fluid flowrate values (the darker portion of the plot in FIG. 10B is above the water line).

Figure 11:
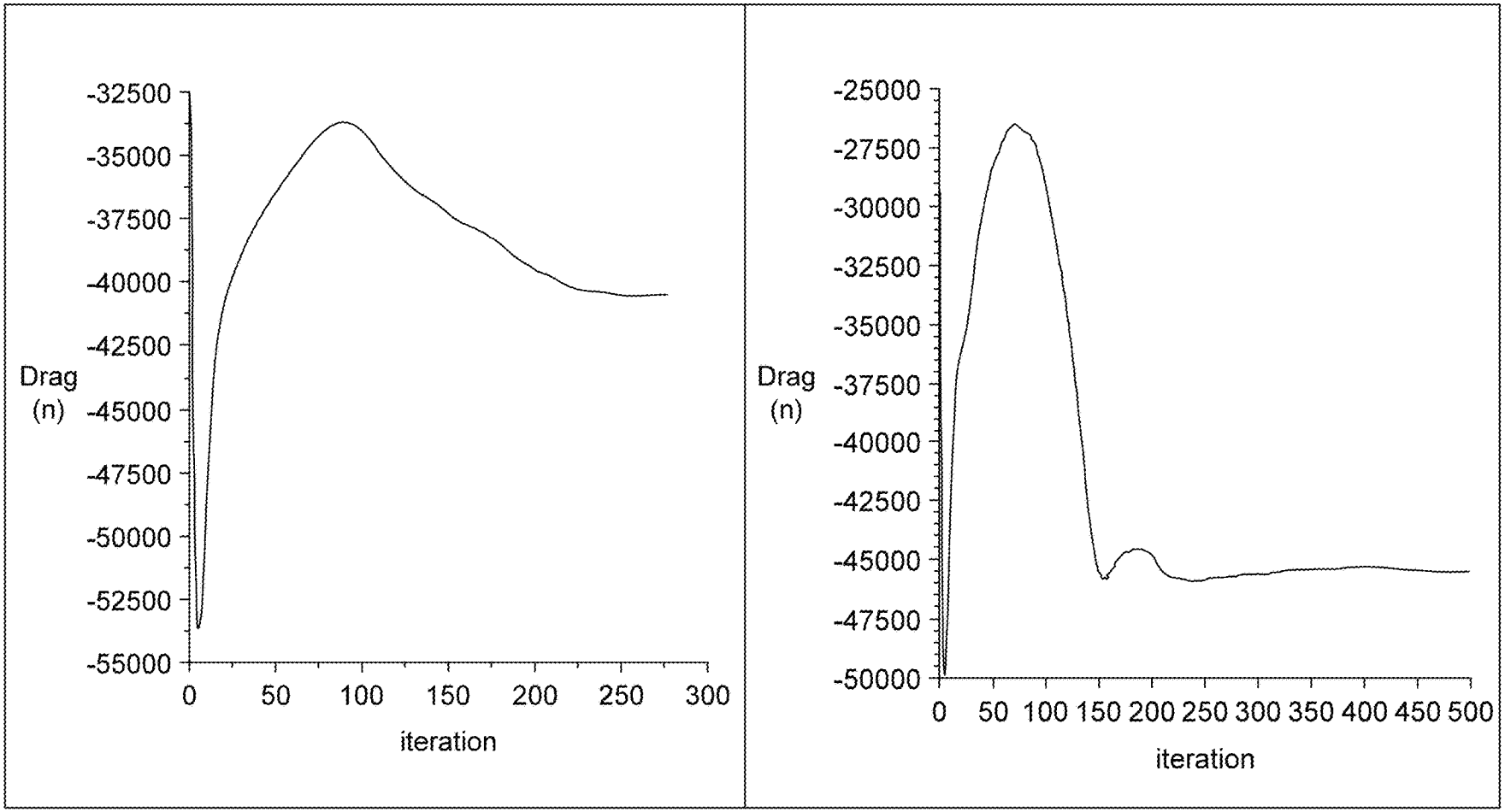
FIG. 11 illustrates a graphical representation of initial computational fluid dynamics drag results of a dual strut (left) compared to a single strut (right) according to embodiments of the present disclosure.

FIG. 11 illustrates a graphical representation of initial computational fluid dynamics drag results of the disclosed dual strut (left) (approximately 37,500 newtons at iteration 150) compared to a traditional single strut (right) (approximately 45,500 newtons at iteration 150). This simulation evidences the hydrodynamic advantages of a dual strut compared to a single strut.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A marine propulsion apparatus comprising:

a first strut and a second strut, each extending from a proximal end to a distal end, each of the first strut and the second strut having a leading portion, an interior belt void, and a trailing portion, wherein the first strut is aligned with the second strut and the first strut is spaced from the second strut, wherein the proximal ends of the first and second struts are coupled to an anti-ventilation plate;

a lower unit housing coupled to the distal ends of the first strut and the second strut, the lower unit housing a sprocket therein;

a shaft rotatably coupled to and concentric with the sprocket, the shaft extending in a first direction;

a propeller coupled to the shaft proximate the tail portion of the lower unit, the propeller configured to rotate with the shaft;

a belt rotatably coupling the drive shaft to the sprocket, wherein the belt is disposed within the interior belt voids of the first and second struts; and at least one thermal circuit channel extending through at least a portion of the anti-ventilation plate, the at least one thermal circuit configured to channel a coolant to flow bidirectionally therethrough.

2. The marine propulsion apparatus of claim 1, wherein the at least one thermal circuit further extends through at least a portion of the first strut.

3. The marine propulsion apparatus of claim 2, wherein the at least one thermal circuit further extends through at least a portion of the second strut.

4. The marine propulsion apparatus of claim 3, wherein the at least one thermal circuit further extends through at least a portion of the lower unit.

5. The marine propulsion apparatus of claim 1, wherein the first and second struts have a complimentary shape.

6. The marine propulsion apparatus of claim 1, wherein the space between first and second struts is uniform over the length of the struts.

7. The marine propulsion apparatus of claim 1, wherein the at least one thermal circuit is disposed within the leading portion of each of the first strut and the second strut.

8. The marine propulsion apparatus of claim 4, wherein the at least one thermal circuit is bidirectional through each of the first strut and the second strut.

9. The marine propulsion apparatus of claim 1, further comprising one or more skegs extending from the lower unit.

10. The marine propulsion apparatus of claim 1, wherein at least one strut and the lower unit are formed as separate components.

11. The marine propulsion apparatus of claim 1, wherein the at least one thermal circuit forms a closed circuit fluid path.

12. The marine propulsion apparatus of claim 1, wherein the interior belt voids and the thermal circuit are discrete channels.

13. A marine propulsion apparatus comprising:

an anti-ventilation plate with an upper side and a lower side, defining a thickness therebetween;

a first strut and a second strut, each extending from a proximal end to a distal end, each of the first strut and the second strut having a leading portion, an interior belt void, and a trailing portion, wherein the first strut is aligned with the second strut and the first strut is spaced from the second strut, and the proximal ends of the first and second struts are coupled to the anti-ventilation plate;

a lower unit coupled to the distal ends of the first strut and the second strut, the lower unit housing a sprocket therein;

a shaft rotatably coupled to and concentric with the sprocket;

a propeller coupled to the shaft proximate the tail portion of the lower unit, the propeller configured to rotate with the shaft;

a belt rotatably coupling the drive shaft to the sprocket, wherein the belt is disposed within the interior belt voids of the first and second struts; and a thermal circuit channel extending through at least one of:

i) the anti-ventilation plate, ii) the first strut, and iii) the second strut, wherein the thermal circuit channel is configured to channel a coolant to flow bidirectionally therethrough.

14. The marine propulsion apparatus of claim 13, wherein the first strut and the second strut are substantially linear.

15. The marine propulsion apparatus of claim 13, wherein the first strut and the second strut each comprise an airfoil shape, wherein a leading edge of the airfoil shape corresponds to the leading portions of the first strut and the second strut and a trailing edge of the airfoil shape corresponds to the trailing portions of the first strut and the second strut.

16. The marine propulsion apparatus of claim 13, wherein the first strut and the second strut are substantially linear.

17. The marine propulsion apparatus of claim 13, wherein a trailing edge of at least one of the first and second struts is removable.

18. The marine propulsion apparatus of claim 13, wherein the anti-ventilation plate, the first strut and the second strut are formed as a continuous component.

19. The marine propulsion apparatus of claim 13, wherein the at least one thermal circuit is bidirectional through each of the anti-ventilation plate, first strut and the second strut.

20. The marine propulsion apparatus of claim 13, wherein the at least one thermal circuit forms a closed circuit fluid path.

* * * * *